US008070559B1

(12) United States Patent
Li et al.

(10) Patent No.: US 8,070,559 B1
(45) Date of Patent: Dec. 6, 2011

(54) ZR-RICH BULK AMORPHOUS ALLOY ARTICLE AND METHOD OF SURFACE GRINDING THEREOF

(75) Inventors: Yang-Yong Li, Shenzhen (CN); Xiao-Bo Yuan, Shenzhen (CN); Yi-Min Jiang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/854,309

(22) Filed: Aug. 11, 2010

(51) Int. Cl.
*B24B 1/00* (2006.01)

(52) U.S. Cl. ..... 451/57; 451/58; 451/37; 451/65; 451/67

(58) Field of Classification Search ..... 451/57, 451/58, 65, 60, 67, 104, 37
See application file for complete search history.

(56) References Cited

U.S. PATENT DOCUMENTS 5,117,321 A * 5/1992 Nakanishi et al. ..... 360/119.09
5,655,954 A * 8/1997 Oishi et al. ..... 451/67
6,117,023 A * 9/2000 Onuki et al. ..... 473/342
6,203,412 B1 * 3/2001 Quek ..... 451/60
6,227,949 B1 * 5/2001 Yi et al. ..... 451/57
6,322,430 B1 * 11/2001 Kennedy et al. ..... 451/287
6,376,009 B1 * 4/2002 Bergvall ..... 427/162
6,431,959 B1 * 8/2002 Mikhaylich et al. ..... 451/41
6,481,088 B1 * 11/2002 Inoue et al. ..... 29/527.5
6,558,238 B1 * 5/2003 Crevasse et al. ..... 451/287
6,582,538 B1 * 6/2003 Inoue et al. ..... 148/561
6,769,961 B1 * 8/2004 Kistler et al. ..... 451/8
6,852,012 B2 * 2/2005 Vepa et al. ..... 451/41
6,957,511 B1 * 10/2005 Leigh et al. ..... 451/36
7,077,728 B1 * 7/2006 Achuthan et al. ..... 451/41
7,799,689 B2 * 9/2010 Wen et al. ..... 438/692
2001/0055941 A1 * 12/2001 Koos et al. ..... 451/57

* cited by examiner

*Primary Examiner* — George Nguyen
(74) *Attorney, Agent, or Firm* — Altis Law Group, Inc.

(57) ABSTRACT

A method of surface grinding a Zr-rich bulk amorphous alloy article includes providing a substrate; providing a first surface grinder for rough surface grinding; and providing a second surface grinder for finish surface grinding. During the rough surface grinding, the rotating speed is in the range from 20 r/min to 30 r/min, the grinding time period is from 3 minutes to 12 minutes, and the grinding pressure is from 1 kg/cm2 to 2 kg/cm2, and a first pump circularly conveys a first lubricant to a first rotating abrasive wheel. During the finish surface grinding, the rotating speed is in the range from 30 r/min to 40 r/min, the grinding time period is from 5 minutes to 7 minutes, and the grinding pressure is from 1 kg/cm$^2$ to 2 kg/cm$^2$, and a second pump circularly conveys a second lubricant to a second rotating abrasive wheel.

11 Claims, 7 Drawing Sheets

ZR-RICH BULK AMORPHOUS ALLOY ARTICLE AND METHOD OF SURFACE GRINDING THEREOF

BACKGROUND

1. Technical Field

The present disclosure generally relates to amorphous alloy articles and methods of surface grinding thereof, and particularly, to a Zr-rich bulk amorphous alloy article and a method of surface grinding thereof.

2. Description of Related Art

Amorphous alloys provide superior magnetic, mechanical, chemical, and other properties in comparison with crystal. Many alloy compositions which can form an amorphous phase, such as Fe systems, Ni systems, Co systems, Al systems, Zr systems, and Ti systems have been developed.

A plurality of devices or components produced from Zr-rich bulk amorphous alloys, such as the housings of electronic devices, has been developed. The housing produced from Zr-rich bulk amorphous alloy often requires a surface treatment to obtain a better appearance. However, during a commonly used surface treatment process, the temperature of the Zr-rich bulk amorphous alloy will be unduly increased, which may cause crystallization, thereby limiting the performance of the amorphous alloy article.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION

Figure 1:
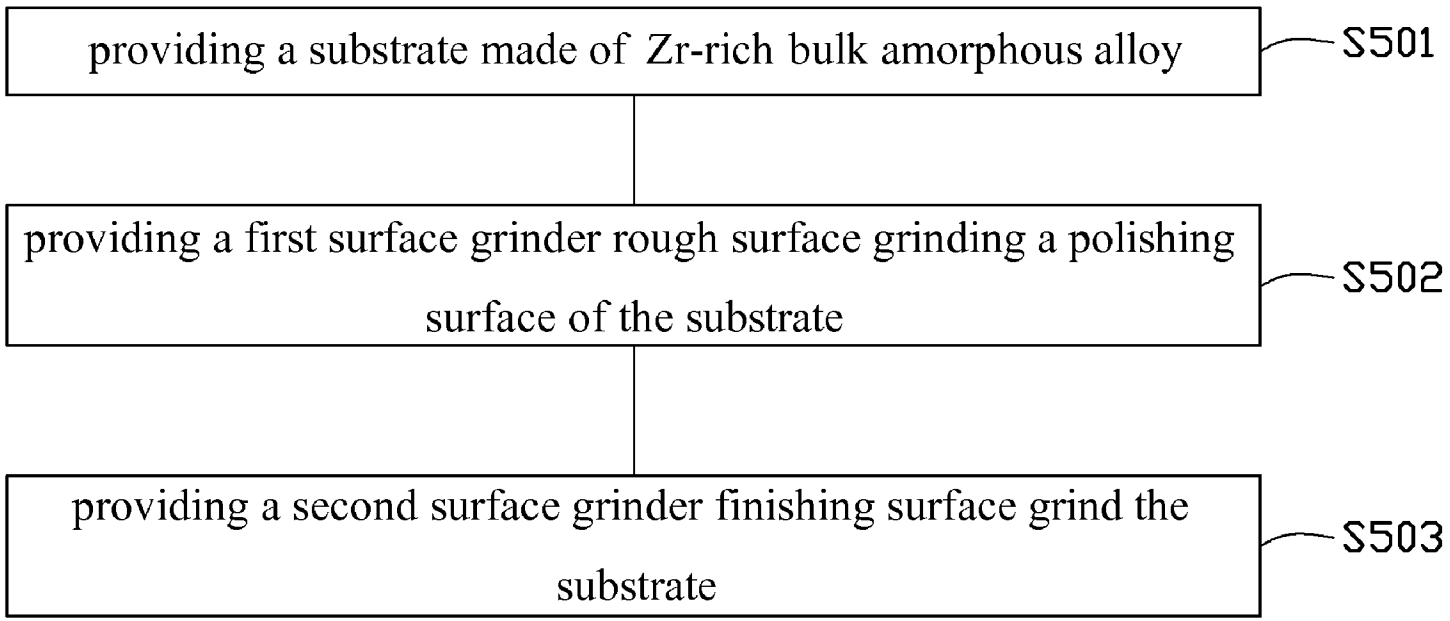
FIG. 1 is a flow chart of one embodiment of a method of surface grinding a Zr-rich bulk amorphous alloy article.

FIG. 1 is a flowchart illustrating an embodiment of a method of surface grinding a Zr-rich bulk amorphous alloy article. Depending on the particular embodiment, some of the steps described below may be removed and other steps may be added.

Figure 2:
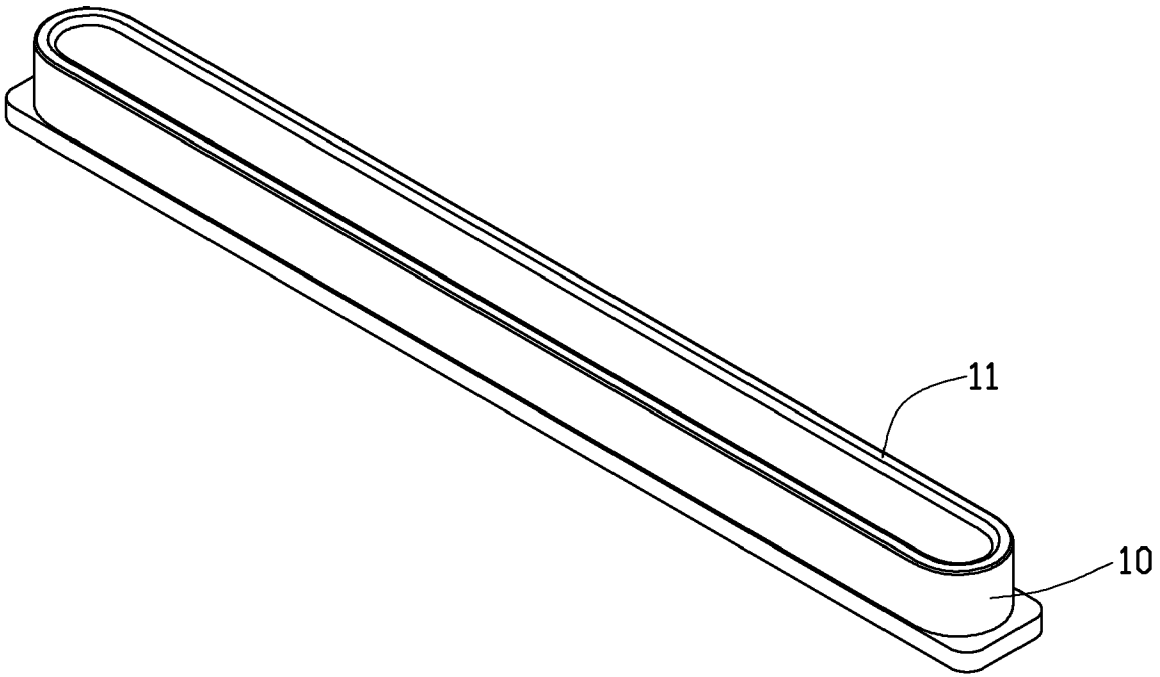
FIG. 2 is an assembled, isometric view of a substrate made of Zr-rich amorphous alloy to be surface grinded to form an embodiment of a Zr-rich amorphous alloy article.
Figure 3:
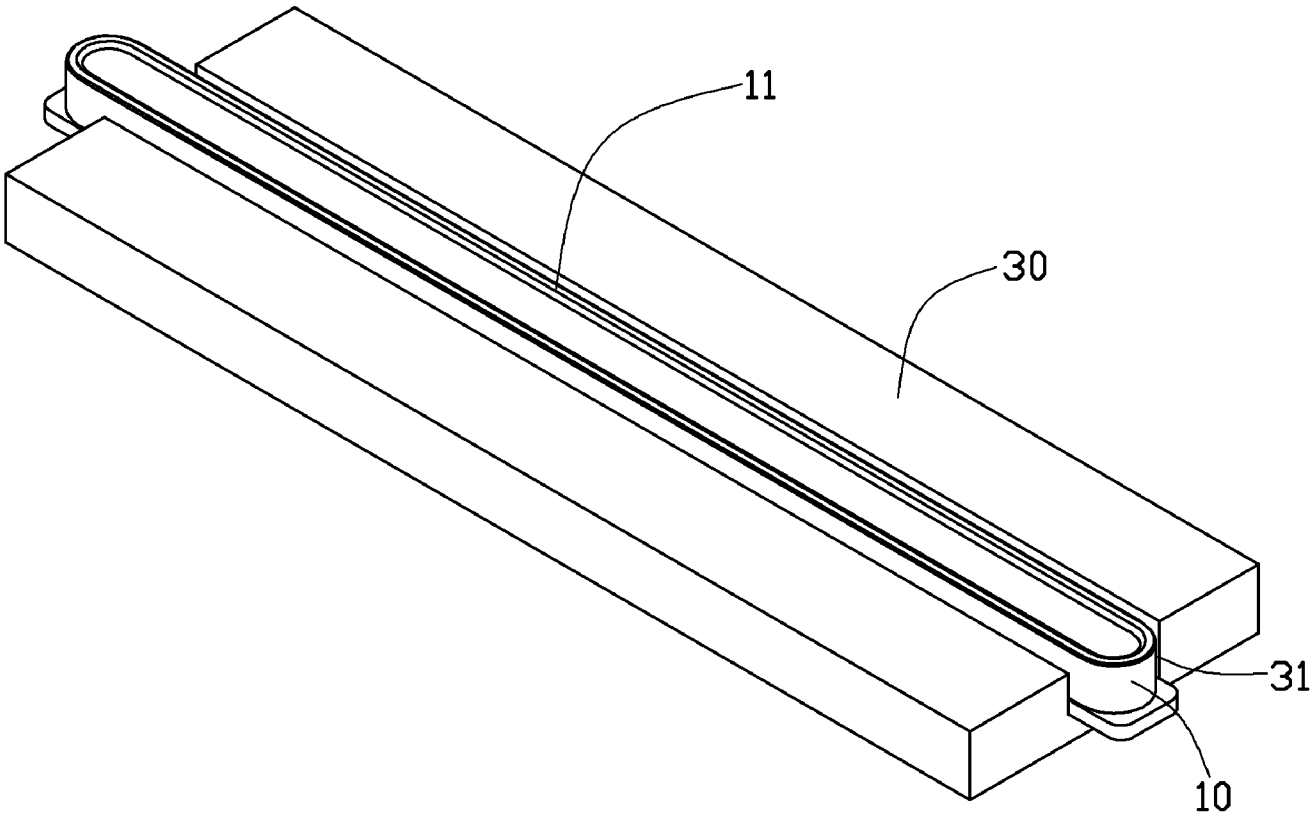
FIG. 3 shows a clamp latching with the substrate of FIG. 2.

Referring to FIGS. 1 through 3, in step S501, a substrate 10 made of Zr-rich bulk amorphous alloy including a polishing surface 11 is provided. The substrate 10 is made of Zr-rich bulk amorphous alloy, such as, Zr—Cu—Al—Ni, Zr—Cu—Al—Ni—Ti, Zr—Cu—Al—Ni—Nb, Zr—Cu—Ni—Ti—Be, Zr—Cu—Al—Ni—Be, and Zr—Cu—Al—Ti—Be alloys. In one embodiment, the substrate 10 is made of Zr—Cu—Al—Ni—Nb alloy.

Furthermore, a clamp 30 is provided to clamp the substrate 10. The clamp 30 defines a latching slot 31 for latching the substrate 10. The height of the latching slot 31 is substantially the same as that of the substrate 10. Thus, when the substrate 10 is latched in the latching slot 31, the polishing surface 11 and one surface of the clamp 30 are substantially on a same plane.

In step S502, a first surface grinder 20 is provided to rough grind the substrate 10.

Figure 4:
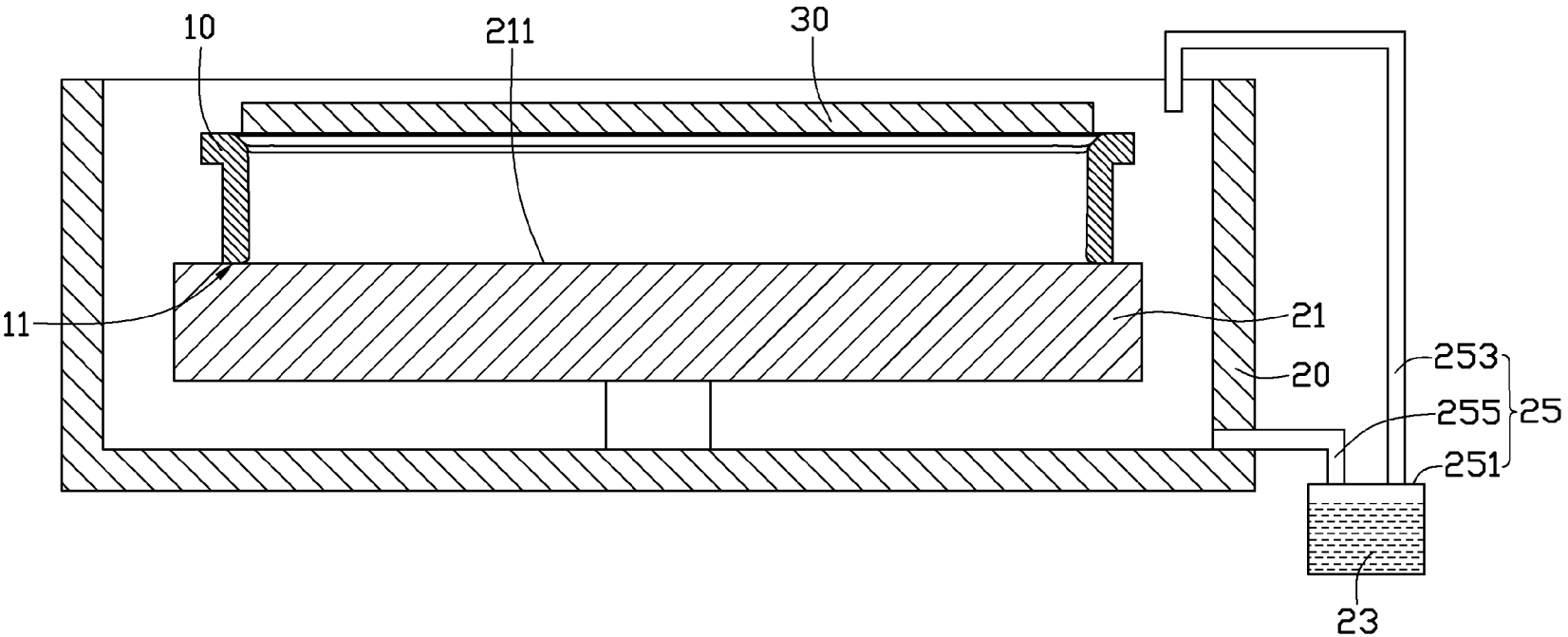
FIG. 4 shows a first surface grinder for rough surface grinding of the substrate of FIG. 2.

Referring to FIG. 4, the first surface grinder 20 includes a first rotating abrasive wheel 21, a first lubricant 23, and a first pump 25. The first rotating abrasive wheel 21 includes a grinding surface 211 on which the substrate 10 and the clamp 30 are placed. The first pump 25 includes a receiving cavity 251, a first guiding pipe 253, and a second guiding pipe 255. One end of the first guiding pipe 253 communicates with the receiving cavity 251; the other end of the first guiding pipe 253 extends above the grinding surface 211 of the first rotating abrasive wheel 21. The opposite ends of the second guiding pipe 255 communicate with the receiving cavity 251 and the bottom of the surface grinder 20, respectively. The first lubricant 23 is filled in the receiving cavity 251 and can be circularly conveyed between the first surface grinder 20 and the receiving cavity 251 by the first pump 25. In one embodiment, the first rotating abrasive wheel 21 is made of cast iron, and the first lubricant 23 is a mixture of grinding particles, oil and water.

During the rough surface grinding process, the clamp 30 and the substrate 10 latched in the latching slot 31 of the clamp 30 are placed on the first rotating abrasive wheel 21 of the first surface grinder 20. The polishing surface 11 of the substrate 10 contacts the grinding surface 211 of the first rotating abrasive wheel 21. The substrate 10 is positioned by the weight of the clamp 30, without any additional positioning devices. Then the first rotating abrasive wheel 21 is rotated, and the first pump 25 is operated simultaneously; and the first lubricant 23 is conveyed from the receiving cavity 251 of the first pump 25 to the first rotating abrasive wheel 21 through the first guiding pipe 253 and flows into the receiving cavity 251 through the second guiding pipe 255. The circulation of the first lubricant 23 can dissipate the heat generated during the rough grinding process and lubricate the polishing surface 11 of the substrate 10, thus decreasing the temperature of the substrate 10 and avoiding crystallization.

After the rough grinding process, the flatness of the polishing surface 11 of the substrate 10 achieved is substantially in the range from 0.5 micrometers to 1.5 micrometers. The rotating speed of the first rotating abrasive wheel 21 is substantially in the range from 20 r/min to 30 r/min, the grinding time period is substantially in the range from 3 minutes to 12 minutes, and the grinding pressure is substantially in the range from 1 $kg/cm^2$ to 2 $kg/cm^2$. In one embodiment, the rotating speed of the first rotating abrasive wheel 21 is about 25 r/min, the grinding time period is about 7 minutes, and the grinding pressure is about 2 $kg/cm^2$, and the flatness of the polished surface of the substrate 10 may reach one micrometer.

In step S503, a second surface grinder 40 is provided to finish surface grinding the substrate 10.

Figure 5:
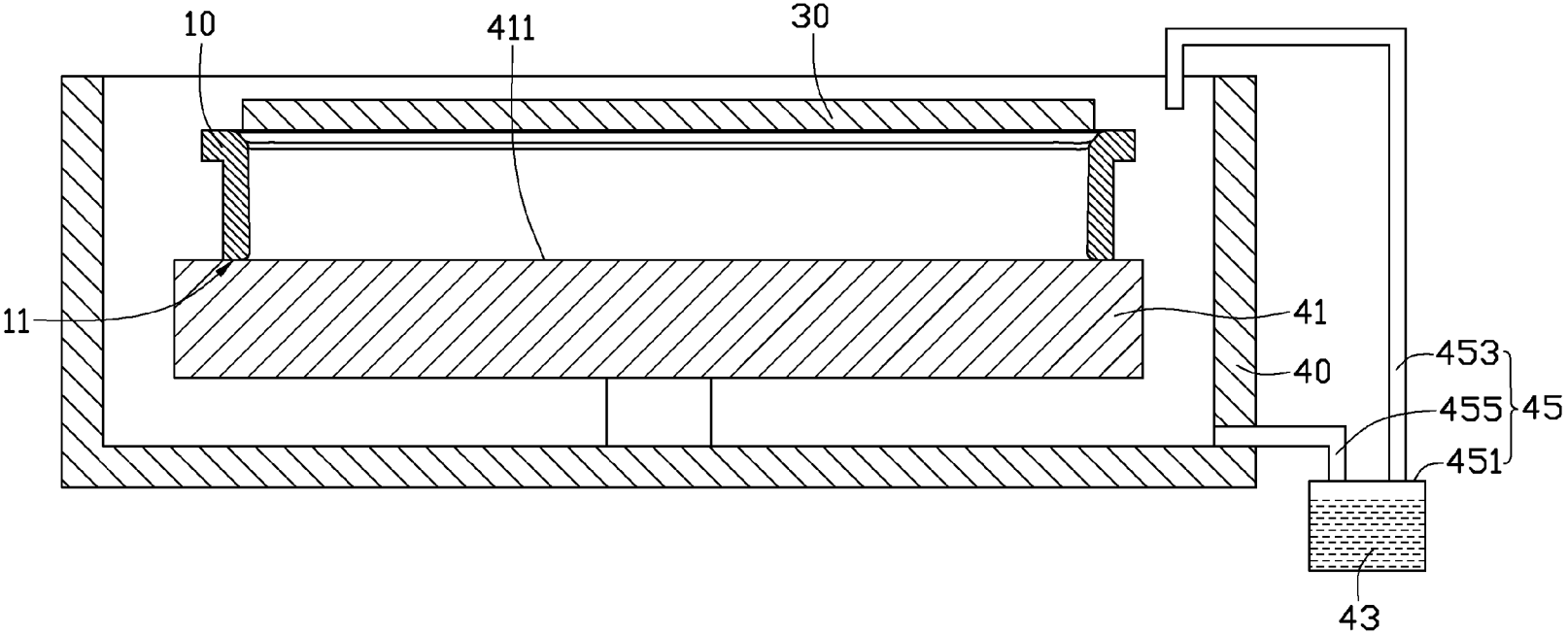
FIG. 5 shows a second surface grinder for finish surface grinding of the substrate of FIG. 2.

Referring to FIG. 5, the second surface grinder 40 is similar to the first surface grinder 20, and also includes a second rotating abrasive wheel 41, a second lubricant 43, and a second pump 45. The second rotating abrasive wheel 41 includes a grinding surface 411. The second pump 45 includes a receiving cavity 451, a first guiding pipe 453, and a second guiding pipe 455. In one embodiment, the second rotating abrasive wheel 41 is made of resin polishing material, and the second lubricant 43 is a polishing solution.

During the finish surface grinding process, the rotating speed of the second rotating abrasive wheel 41 is substantially in the range from 30 r/min to 40 r/min, the grinding time period is in the range from 5 minutes to 7 minutes, and the grinding pressure is in the range from 1 kg/cm$^2$ to 2 kg/cm$^2$. In one embodiment, the rotating speed of the second rotating abrasive wheel 41 is about 35 r/min, the grinding time period is about 7 minutes, and the grinding pressure is about 2 kg/cm$^2$.

Figure 6:
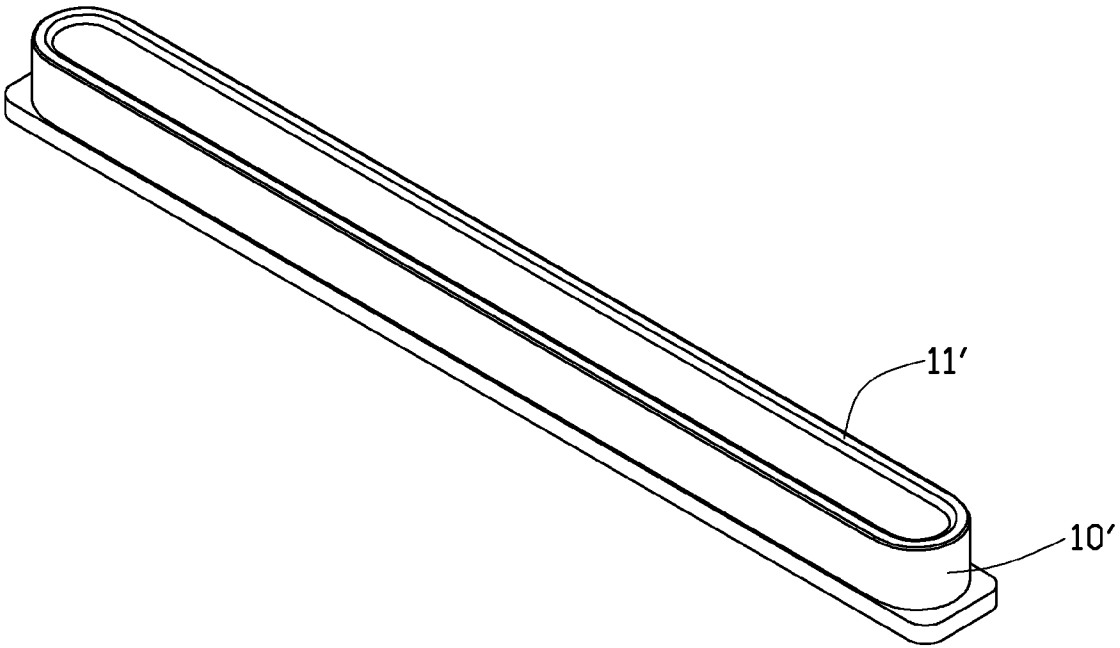
FIG. 6 is an isometric view of a housing treated by a Zr-rich amorphous alloy surface grinding method, for example the method of FIG. 1.

Referring to FIG. 6, after the finish surface grinding, a Zr-rich bulk amorphous alloy article 10' is formed, and the polishing surface 11 of the substrate 10 is transformed to the polished surface 11'. The flatness of the polished surface 11' is about one micrometer and the surface roughness of the polished surface 11' is less than 0.1 micrometers.

Figure 7:
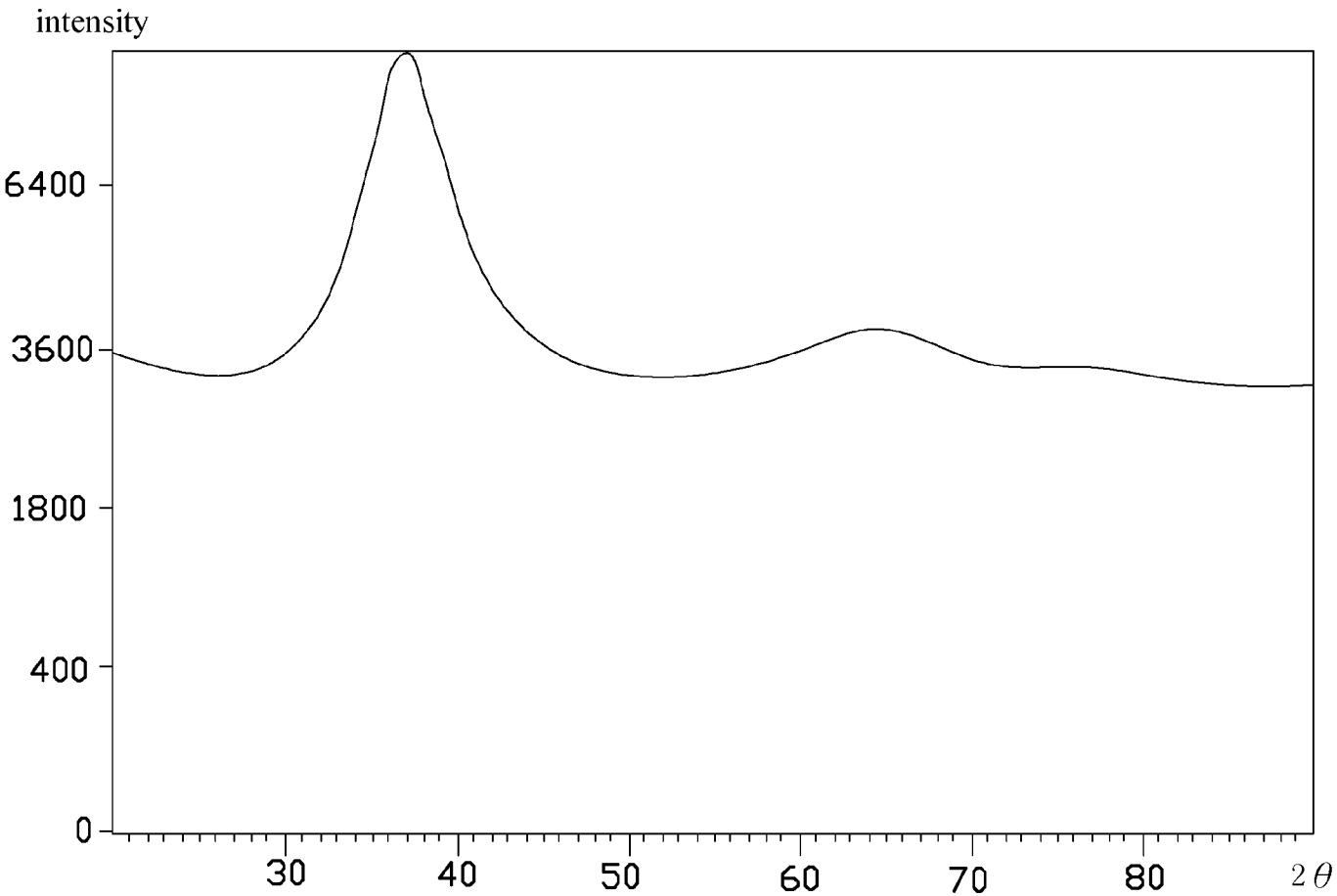
FIG. 7 is an X-ray diffraction graph of the polished surface of the housing of FIG. 6.

Referring to FIG. 7, an X-ray diffraction graph of the polished surface 11' of the article 10' is shown. As shown in FIG. 7, the X-ray diffraction graph has only one peak at about 37 degrees, which indicates that no crystallization has been experienced in the article 10'.

Alternatively, the Zr-rich bulk amorphous alloy surface grinding method may include a step for cleaning the substrate 10 after the rough surface grinding process, thus, the flatness and the surface roughness of the polished surface 11' of the article 10' may be further improved.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A method of surface grinding Zr-rich bulk amorphous alloy article, comprising:

providing a substrate made of Zr-rich bulk amorphous alloy;

providing a first surface grinder comprising a first rotating abrasive wheel, a first lubricant, and a first pump for circularly conveying the first lubricant to the first rotating abrasive wheel;

rough surface grinding a polishing surface of the substrate in such a manner that the rotating speed of the first rotating abrasive wheel is substantially in the range from 20 r/min to 30 r/min, the grinding time period is substantially in the range from 3 minutes to 12 minutes, and the grinding pressure is substantially in the range from 1 kg/cm$^2$ to 2 kg/cm$^2$, and the first pump circularly conveys the first lubricant to the first rotating abrasive wheel;

providing a second surface grinder comprising a second rotating abrasive wheel, a second lubricant, and a second pump for circularly conveying the second lubricant to the second rotating abrasive wheel; and finish surface grinding the polishing surface of the substrate in such a manner that the rotating speed of the second rotating abrasive wheel is substantially in the range from 30 r/min to 40 r/min, the grinding time period is substantially in the range from 5 minutes to 7 minutes, and the grinding pressure is substantially in the range from 1 kg/cm$^2$ to 2 kg/cm$^2$, and the second pump circularly conveys the second lubricant to the second rotating abrasive wheel.

2. The method of surface grinding Zr-rich bulk amorphous alloy article of claim 1, further comprising providing a clamp and mounting the substrate in the clamp, wherein the substrate is positioned by the weight of the clamp and the polishing surface of the substrate contacts the grinding surface of the first rotating abrasive wheel.

3. The method of surface grinding Zr-rich bulk amorphous alloy article of claim 1, wherein the substrate is selected from the group consisting of Zr—Cu—Al—Ni, Zr—Cu—Al—Ni—Ti, Zr—Cu—Al—Ni—Nb, Zr—Cu—Ni—Ti—Be, Zr—Cu—Al—Ni—Be, and Zr—Cu—Al—Ti—Be alloys.

4. The method of surface grinding Zr-rich bulk amorphous alloy article of claim 3, wherein the substrate is made of Zr—Cu—Al—Ni—Nb alloy.

5. The method of surface grinding Zr-rich bulk amorphous alloy article of claim 1, wherein during the rough surface grinding process, the rotating speed of the first rotating abrasive wheel is about 25 r/min, the grinding time period is about 7 minutes, and the grinding pressure is about 2 kg/cm$^2$.

6. The method of surface grinding Zr-rich bulk amorphous alloy article of claim 1, wherein during the finish surface grinding process, the rotating speed of the second rotating abrasive wheel is about 35 r/min, the grinding time period is about 7 minutes, and the grinding pressure is about 2 kg/cm$^2$.

7. The method of surface grinding Zr-rich bulk amorphous alloy article of claim 1, wherein the second rotating abrasive wheel is made of resin polishing material.

8. The method of surface grinding Zr-rich bulk amorphous alloy article of claim 1, wherein the first lubricant is a mixture of grinding particles, oil and water.

9. The method of surface grinding Zr-rich bulk amorphous alloy article of claim 1, wherein the second lubricant is a polishing solution.

10. The method of surface grinding Zr-rich bulk amorphous alloy article of claim 1, further comprising cleaning the substrate after the rough surface grinding process and before the finish surface grinding process.

11. The method of surface grinding Zr-rich bulk amorphous alloy article of claim 1, wherein the first rotating abrasive wheel is made of cast iron.

* * * * *